US009138999B2

(12) United States Patent
Arai et al.

(10) Patent No.: US 9,138,999 B2
(45) Date of Patent: Sep. 22, 2015

(54) INK JET HEAD AND IMAGE FORMING APPARATUS

(71) Applicant: Toshiba Tec Kabushiki Kaisha, Tokyo (JP)

(72) Inventors: Ryuichi Arai, Shizuoka-ken (JP); Chiaki Tanuma, Tokyo (JP); Ryutaro Kusunoki, Shizuoka-ken (JP); Shuhei Yokoyama, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/015,581

(22) Filed: Aug. 30, 2013

(65) Prior Publication Data

US 2014/0063130 A1 Mar. 6, 2014

(30) Foreign Application Priority Data

Aug. 31, 2012 (JP) ..... 2012-191808

(51) Int. Cl.

| | |
|---|---|
| ***B41J 2/015*** | (2006.01) |
| ***B41J 2/14*** | (2006.01) |
| ***B41J 2/16*** | (2006.01) |

(52) U.S. Cl.

CPC ..... *B41J 2/14233* (2013.01); *B41J 2/1433* (2013.01); *B41J 2/1621* (2013.01); *B41J 2002/14475* (2013.01); *B41J 2202/15* (2013.01); *Y10T 29/42* (2015.01)

(58) Field of Classification Search

None

See application file for complete search history.

(56) References Cited

U.S. PATENT DOCUMENTS

| | | | | |
|---|---|---|---|---|
| 2009/0038152 | A1* | 2/2009 | Wakayama et al. | 29/890.1 |
| 2009/0237468 | A1 | 9/2009 | Kanemoto | |
| 2012/0056947 | A1* | 3/2012 | Tanuma et al. | 347/71 |
| 2013/0070027 | A1* | 3/2013 | Arai et al. | 347/68 |
| 2013/0222484 | A1 | 8/2013 | Yokoyama et al. | |

FOREIGN PATENT DOCUMENTS

| | | |
|---|---|---|
| JP | 2000-289201 | 10/2000 |
| JP | 2005-306017 | 11/2005 |
| JP | 2008-149659 | 7/2008 |
| JP | 2009-096128 | 5/2009 |

OTHER PUBLICATIONS

Coefficients of Linear Thermal Expansion. (n.d.). Retrieved from http://www.engineeringtoolbox.com/linear-expansion-coefficients-d_95.html.*

U.S. Appl. No. 13/786,311, Yokoyama et al., titled "Ink-Jet Head and Manufacturing Method of the Same," filed Mar. 5, 2013.

Office Action dated May 13, 2014, filed in Japanese Patent Application No. 2012-191808, with English translation.

* cited by examiner

*Primary Examiner* — Erica Lin

(74) *Attorney, Agent, or Firm* — Patterson & Sheridan, LLP

(57) ABSTRACT

An ink jet head according to an embodiment comprises a substrate including amounting surface and a pressure chamber open to the mounting surface, the substrate having a first expansion coefficient. The ink jet head further comprises a vibration plate including a first surface fixed to the mounting surface of the substrate, a second surface located on the opposite side of the first surface, an opening portion open to the pressure chamber, a first portion having a second expansion coefficient different from the first expansion coefficient, and a second portion having a third expansion coefficient different from the second expansion coefficient. The ink jet head further comprises a piezoelectric element provided on the second surface of the vibration plate and configured to deform the vibration plate to thereby change a volume of the pressure chamber.

11 Claims, 8 Drawing Sheets

INK JET HEAD AND IMAGE FORMING APPARATUS

CROSS-REFERENCE TO RELATED APPLICATION

This application is based upon and claims the benefit of priority from Japanese Patent Application No. 2012-191808, filed on Aug. 31, 2012, the entire contents of which are incorporated herein by reference.

FIELD

Embodiments described herein relate generally to an ink jet head and an image forming device.

BACKGROUND

On-demand type ink jet recording methods are known in which ink droplets are discharged from a nozzle according to an image signal to form an image on a recording paper. On-demand type ink jet recording methods include a heating element type ink jet recording method and a piezoelectric element type ink jet recording method.

In the heating element type ink jet recording method, air bubbles are generated in ink by heat provided by a heat source in an ink flow channel. The ink pressed by the air bubbles is discharged from a nozzle.

In the piezoelectric element type ink jet recording method, a pressure change occurs in an ink chamber, where ink is stored, due to the deformation of a piezoelectric element. Thus the ink is discharged from a nozzle.

A piezoelectric element is an electromechanical conversion element, and undergoes expansion or shear deformation when an electric field is applied thereto. Lead zirconate titanate is used as a representative piezoelectric element.

With respect to an ink jet head using a piezoelectric element, a configuration using a nozzle plate formed of a piezoelectric material is known. The nozzle plate of the ink jet head includes an actuator. The actuator includes, for example, a piezoelectric film having a nozzle for discharging ink, and a metal electrode film formed on both surfaces of the piezoelectric film surrounding the nozzle.

The ink jet head includes a pressure chamber that is connected to the nozzle. Ink enters the pressure chamber and the nozzle of the nozzle plate and forms a meniscus within the nozzle, and thus the ink is maintained within the nozzle. When a driving waveform (voltage) is applied to the two electrodes provided around the nozzle on either side of the piezoelectric film, an electric field in the same direction as a polarization direction is applied to the piezoelectric film through the electrodes. Thereby, the actuator expands and contracts in a direction perpendicular to the direction of the electric field. The nozzle plate deforms by virtue of the expansion and the contraction of the actuator. A pressure change occurs in the ink within the pressure chamber due to the deformation of the nozzle plate, and the ink within the nozzle is discharged.

DETAILED DESCRIPTION

An ink jet head according to an embodiment comprises a substrate including amounting surface and a pressure chamber open to the mounting surface, the substrate having a first expansion coefficient. The ink jet head further comprises a vibration plate including a first surface fixed to the mounting surface of the substrate, a second surface located on the opposite side of the first surface, an opening portion open to the pressure chamber, a first portion having a second expansion coefficient different from the first expansion coefficient, and a second portion having a third expansion coefficient different from the second expansion coefficient. The ink jet head further comprises a piezoelectric element provided on the second surface of the vibration plate and configured to deform the vibration plate to thereby change a volume of the pressure chamber.

Hereinafter, a first embodiment will be described with reference to FIG. 1 through FIG. 4.

Figure 1:
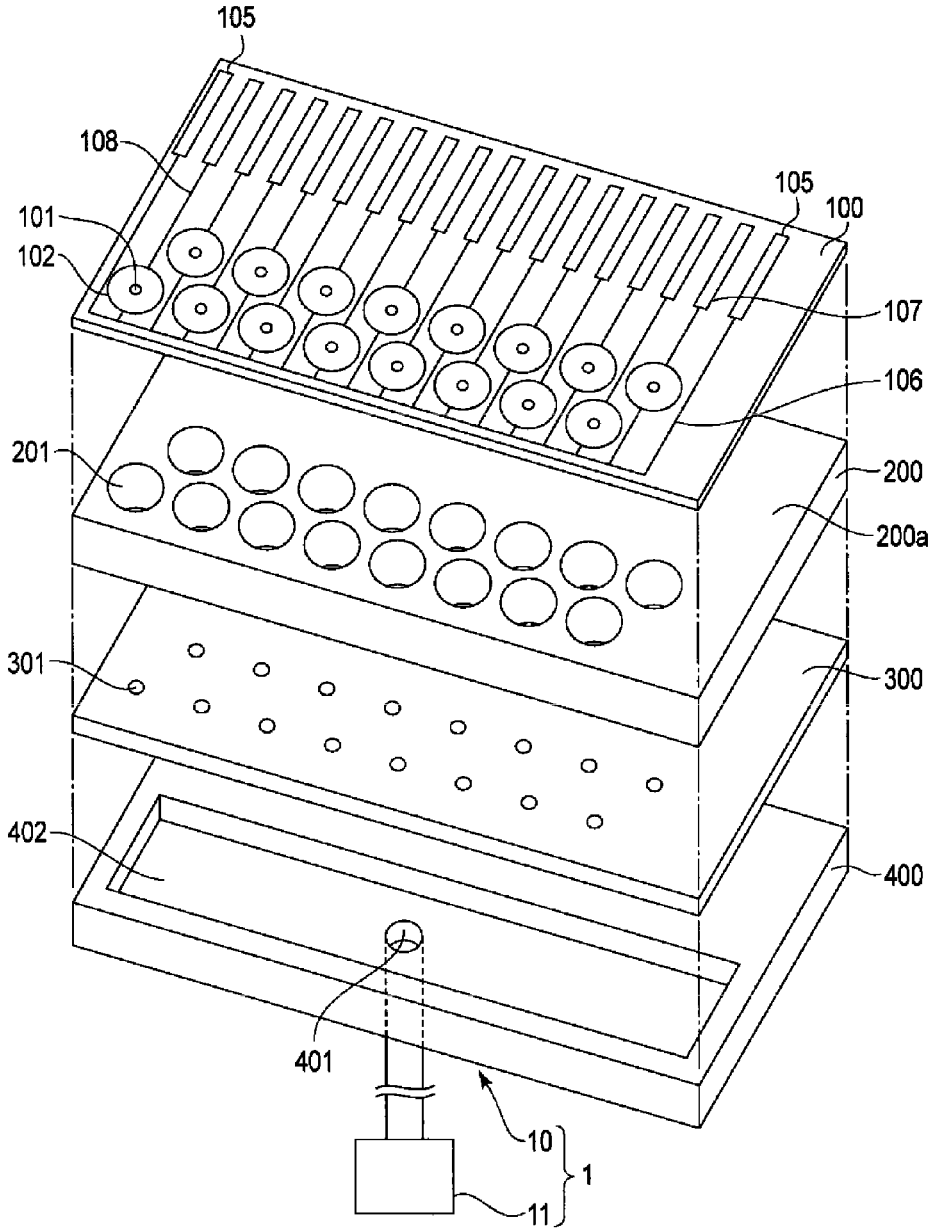
FIG. 1 is an exploded perspective view of an ink jet head of an ink jet printer, according to a first embodiment.
Figure 2:
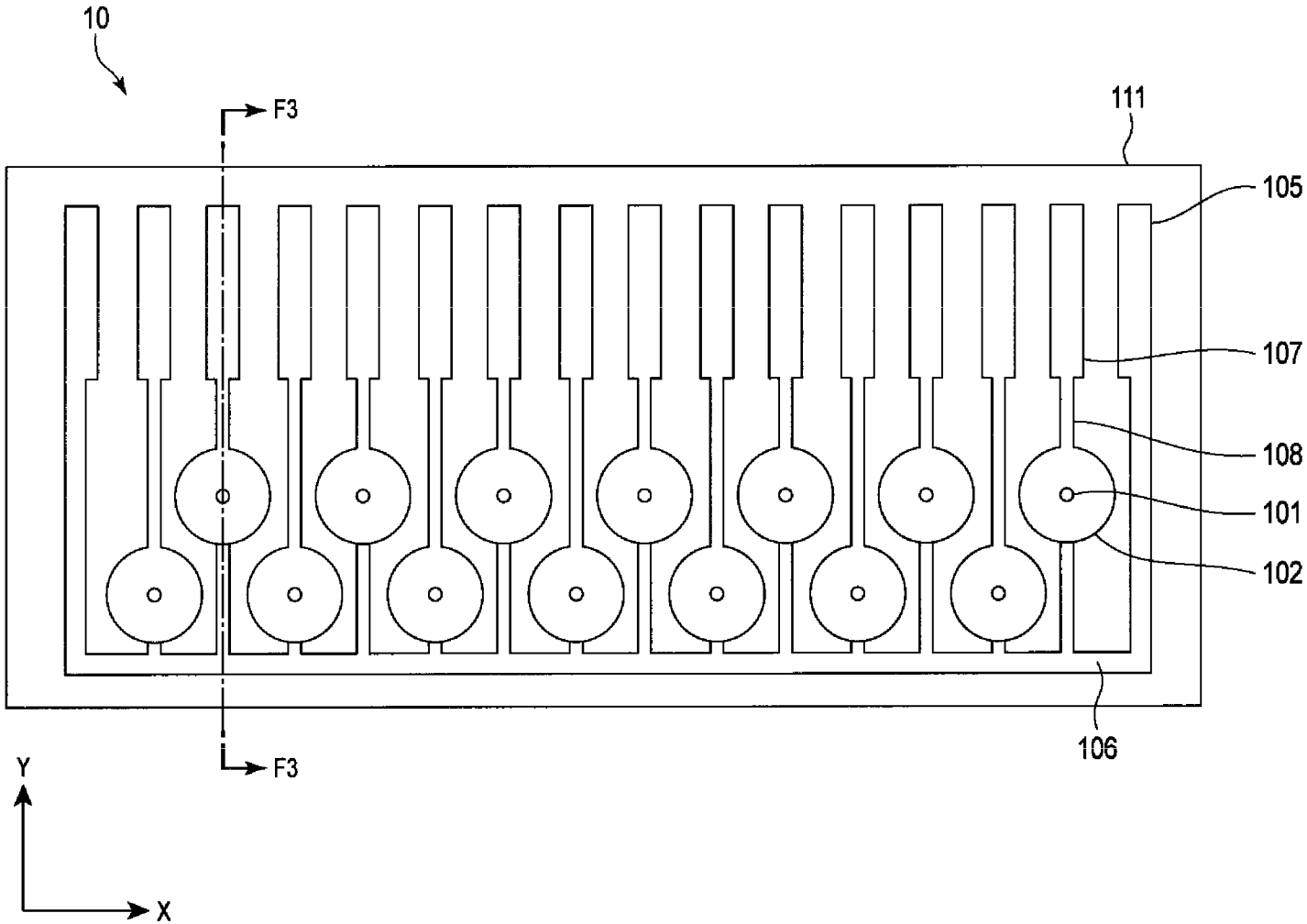
FIG. 2 is a plane view of the ink jet head according to the first embodiment.
Figure 3:
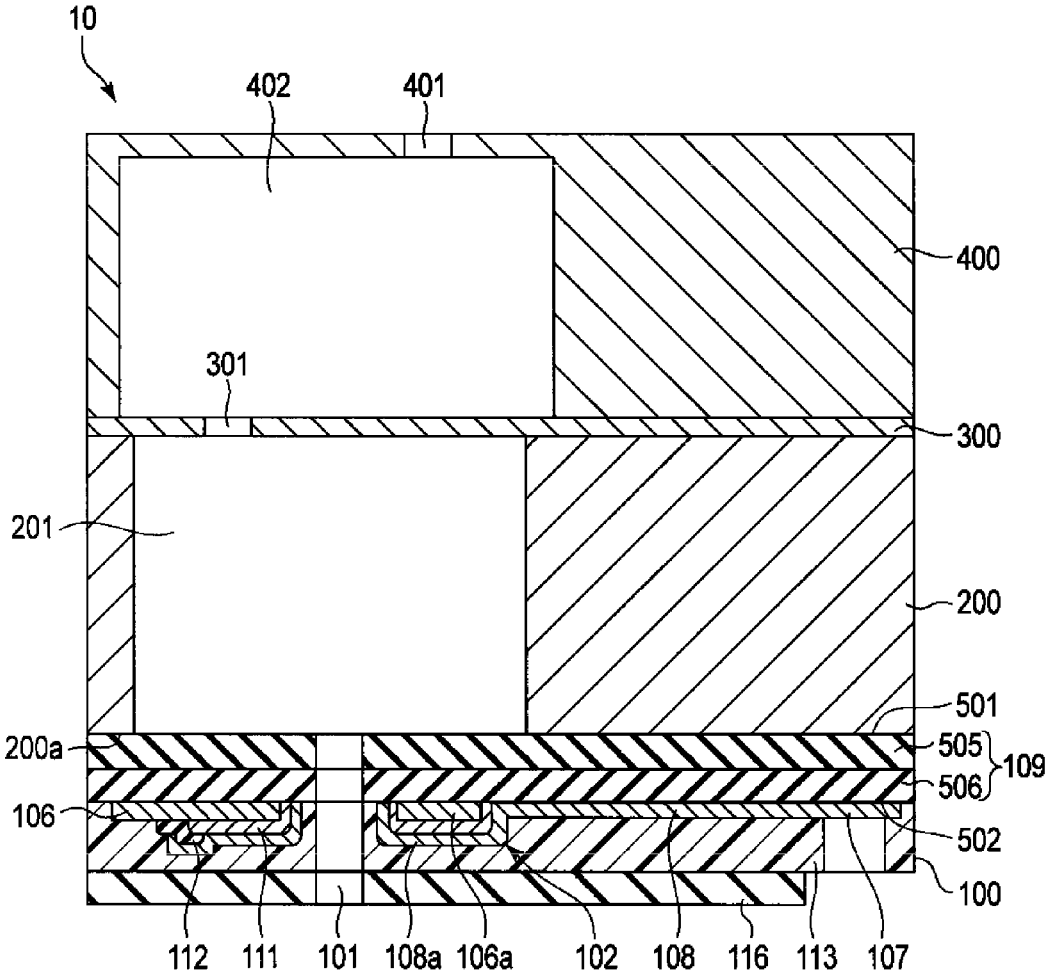
FIG. 3 is a cross-sectional view of the ink jet head of the first embodiment taken along line F3-F3 of FIG. 2.

FIG. 1 is an exploded perspective view of an ink jet head 10 of an ink jet printer 1 according to a first embodiment. FIG. 2 is a plane view of the ink jet head 10. FIG. 3 is a schematic cross-sectional view of the ink jet head 10 taken along line F3-F3 of FIG. 2.

As shown in FIG. 1, the ink jet head 10 is mounted on the ink jet printer 1. The ink jet printer 1 is an example of an image forming apparatus. The image forming apparatus is not limited thereto, and may be any other image forming apparatus such as a copy machine.

The ink jet head 10 includes a nozzle plate 100, a pressure chamber structure 200, a separate plate 300, and an ink feed passage structure 400. The pressure chamber structure 200 can be formed from a substrate. The pressure chamber structure 200, the separate plate 300, and the ink feed passage structure 400 are joined with, for example, an epoxy-based adhesive.

The nozzle plate 100 is formed in a rectangular plate shape. The nozzle plate 100 is formed on the pressure chamber structure 200 by using a film-forming process, described below. As a result of the film-forming process, the nozzle plate 100 is firmly fixed to the pressure chamber structure 200.

A plurality of nozzles 101 for discharging ink are provided in the nozzle plate 100. Each nozzle 101 is an example of an opening portion. Each nozzle 101 is a circular hole that penetrates the nozzle plate 100 in the thickness direction.

The pressure chamber structure 200 is formed of a silicon wafer having a rectangular plate shape. Heating and thin-film formation are repeatedly performed on the pressure chamber structure 200 during a manufacturing process of the ink jet head 10. For this reason, the silicon wafer has a heat resistance property and is smoothed according to an SEMI (Semiconductor Equipment and Materials International) standard. However, the pressure chamber structure 200 is not limited to the above description, and may be formed of any of other semiconductors such as a silicon carbide (SiC) germanium substrate.

An expansion coefficient of the silicon wafer for forming the pressure chamber structure 200 is $4\times10^{-6}[K^{-1}]$. That is, a first expansion coefficient in the first embodiment is $4\times10^{-6}[K^{-1}]$.

The pressure chamber structure 200 includes a mounting surface 200*a* that faces the nozzle plate 100, and a plurality of pressure chambers 201. The nozzle plate 100 is firmly fixed to the mounting surface 200*a*.

The pressure chamber 201 is comprised of a circular hole, i.e., a counterbored recess, for example. However, the pressure chamber 201 may be a hole having any of other shapes such as a rectangular shape or a rhombic shape. The pressure chambers 201 open on the mounting surface 200*a* and are covered by the nozzle plate 100.

The plurality of pressure chambers 201 are arranged to correspond to the plurality of nozzles 101, and are disposed coaxially with the plurality of nozzles 101, respectively. For this reason, each nozzle 101 is in direct communication with a corresponding pressure chamber 201.

The separate plate 300 is formed of stainless steel having a rectangular plate shape. The separate plate 300 covers the plurality of pressure chambers 201 on the side opposite of the nozzle plate 100.

A plurality of ink apertures 301 are provided in the separate plate 300. Each of the plurality of ink apertures 301 are disposed so as to respectively correspond to one of the pressure chambers 201. For this reason, each ink aperture 301 opens in one of the pressure chambers 201. The ink apertures 301 are formed such that the ink flow path resistance to each of the respective pressure chambers 201 is approximately the same.

The ink feed passage structure 400 is formed of stainless steel having a rectangular plate shape. The ink feed passage structure 400 includes an ink supply port 401 and an ink supply passage 402.

The ink supply port 401 is disposed in a central portion of the ink supply passage 402. The ink supply port 401 is connected to an ink tank 11 in which ink for forming an image is stored. The ink tank 11 supplies the ink to the ink supply passage 402.

The ink supply passage 402 is recessed from the surface of the ink feed passage structure 400, and extends outwardly beyond the perimeter of the array of ink apertures 301. In other words, each of the ink apertures 301 open into the ink supply passage 402. Thus, the ink supply port 401 supplies ink to all the pressure chambers 201 through the ink apertures 301. In addition, the ink supply port 401 is formed such that the ink flow path resistance to each of the respective pressure chambers 201 is approximately the same.

As described above, the separate plate 300 and the ink feed passage structures 400 may be formed of stainless steel. However, the materials of such components are not limited to stainless steel. The separate plate 300 and the ink feed passage structure 400 may be formed of any of other materials such as a ceramic, a resin, or a metal alloy so long as a difference in expansion coefficient between the separate plate 300 and the ink feed passage structure 400 on the one hand, and the nozzle plate 100, on the other hand does not affect the generation of ink discharge pressure. The ceramic used maybe a nitride or an oxide such as alumina ceramic, zirconia, silicon carbide, silicon nitride, or barium titanate. The resin used may be a plastic material such as ABS (acrylonitrile.butadiene.styrene), polyacetal, polyamide, polycarbonate, or polyethersulfone. The metal used may be, for example, aluminum or titanium.

The pressure chamber 201 holds the supplied ink. When a pressure change occurs in the ink within each pressure chamber 201 by the deformation of the nozzle plate 100, the ink within the pressure chamber 201 is discharged from each nozzle 101. The separate plate 300 confines pressure generated within the pressure chambers 201 so as to prevent the pressure from escaping to the ink supply passage 402. For this reason, the diameter of the ink aperture 301 is, for example, equal to or less than ¼ of the diameter of the pressure chamber 201.

Next, the nozzle plate 100 will be described. As shown in FIG. 2, the nozzle plate 100 includes the above-mentioned plurality of nozzles 101, a plurality of actuators 102, two shared electrode terminal portions 105, a shared electrode 106, a plurality of wiring electrode terminal portions 107, and a plurality of wiring electrodes 108. As shown in FIG. 3, the nozzle plate 100 further includes a vibration plate 109, a protective film 113, and an ink-repellent film 116. The actuator 102 is an example of a piezoelectric element.

The vibration plate 109 has a rectangular shape and is formed on the mounting surface 200*a* of the pressure chamber structure 200. The vibration plate 109 includes a first surface 501 and a second surface 502.

The first surface 501 is firmly fixed to the mounting surface 200*a* of the pressure chamber structure 200 and covers the pressure chambers 201, except in the location of the nozzle 101 extending therethrough. The second surface 502 is located on the opposite side of the first surface 501. The actuators 102, the shared electrode 106, and the wiring electrodes 108 are formed on the second surface 502 of the vibration plate 109.

The plurality of actuators 102 are arranged so that each corresponds to one of the plurality of pressure chambers 201 and one of the plurality of nozzles 101. The actuator 102 generates pressure for discharging ink in the pressure chamber 201 from the nozzle 101.

As shown in FIG. 2, the actuator 102 is formed in an annular shape. The actuator 102 is disposed coaxially with the corresponding nozzle 101. Accordingly, the nozzle 101 is provided on the inner side of the actuator 102.

In order to arrange the nozzles 101 with higher density, the nozzles 101 are disposed in a zigzag shape. In other words, the plurality of nozzles 101 are arranged linearly in an X-axis direction of FIG. 2. Two aligned rows of the nozzles 101 are provided in a Y-axis direction.

As shown in FIG. 3, the actuator 102 includes a piezoelectric film 111, an electrode portion 106*a* of the shared electrode 106, an electrode portion 108*a* of the wiring electrode 108, and an insulating film 112.

The piezoelectric film 111 may be formed of lead zirconate titanate (PZT) in a film shape. The piezoelectric film 111 is not limited to that material, and may be formed of any of various materials such as PTO ($PbTiO_3$: lead titanate), PMNT ($Pb(Mg_{1/3}Nb_{2/3})O_3$—$PbTiO_3$), PZNT ($Pb(Zn_{1/3}Nb_{2/3})O_3$—$PbTiO_3$) ZnO, and AlN.

The piezoelectric film 111 is formed in an annular shape. The piezoelectric film 111 is disposed coaxially with the nozzle 101 and the pressure chamber 201. In other words, the piezoelectric film 111 surrounds the nozzle 101. An inner circumferential portion of the piezoelectric film 111 is slightly separated from the nozzle 101.

The piezoelectric film 111 is sandwiched between the electrode portion 108*a* of the wiring electrode 108 and the electrode portion 106*a* of the shared electrode 106. In other words, the electrode portion 108*a* of the wiring electrode 108 and the electrode portion 106*a* of the shared electrode 106 disposed on either side of the piezoelectric film 111.

The formed piezoelectric film 111 generates polarization in the thickness direction. When an electric field is applied to the piezoelectric film 111 in the same direction as the polarization direction through the wiring electrode 108 and the shared electrode 106, the actuator 102 expands and contracts in a direction perpendicular to the direction of the electric field. The vibration plate 109 is deformed in the thickness direction of the nozzle plate 100 by the expansion and the contraction of the actuator 102. The capacity of the pressure chamber 201 is changed, and a pressure change occurs in the ink within the pressure chamber 201.

The electrode portion 108*a* of the wiring electrode 108 is one of two electrodes connected to the opposed sides of the piezoelectric film 111. The electrode portion 108*a* of the wiring electrode 108 is formed with an annular shape larger than that of the piezoelectric film 111, and is formed on the discharge side (the side facing the outside of the ink jet head 10) of the piezoelectric film 111.

The electrode portion 106*a* of the shared electrode 106 is one of the two electrodes connected to the piezoelectric film 111. The electrode portion 106*a* of the shared electrode 106 is formed in an annular shape smaller than that of the piezoelectric film 111, and is formed on the second surface 502 of the vibration plate 109. The electrode portion 106*a* of the shared electrode 106 is formed on the second surface 502 of the vibration plate 109.

The insulating film 112 is sandwiched between the shared electrode 106 and the wiring electrode 108 on the outside of a region in which the piezoelectric film 111 is formed. That is, the shared electrode 106 and the wiring electrode 108 are insulated from each other by the piezoelectric film 111 or the insulating film 112. The insulating film 112 may be formed of, for example, $SiO_2$ (silicon oxide). The insulating film 112 may be formed of any of other materials.

A driving circuit is connected to the shared electrode terminal portions 105 and the wiring electrode terminal portions 107. The driving circuit may be, for example, a flexible printed circuit board or a tape carrier package (TCP).

The wiring electrode terminal portion 107 is provided at an end of the wiring electrode 108. The wiring electrode terminal portion 107 is connected to the driving circuit and transmits a signal for driving the actuator 102.

As shown in FIG. 2, an interval between the wiring electrode terminal portions 107 is the same as an interval between the nozzles 101 in the X-axis direction. The width of the wiring electrode terminal portion 107 in the X-axis direction is wider than the width of the wiring electrode 108. For this reason, the wiring electrode terminal portion 107 is easily connected to the driving circuit.

For example, the shared electrode terminal portions 105 are provided on the second surface 502 of the vibration plate 109. The shared electrode terminal portion 105 is an end of the shared electrode 106 and is connected to a GND (ground=0 V) provided in the driving circuit.

The wiring electrodes 108 are each individually connected to the piezoelectric films 111 of the corresponding actuators 102 and each transmit a signal for driving the respective actuators 102. Each wiring electrode 108 is used as an individual electrode for operating the piezoelectric film 111 independently of other piezoelectric films 111 on the nozzle plate 100. Each of the plurality of wiring electrodes 108 includes the above-mentioned electrode portion 108*a*, a wiring portion, and the above-mentioned wiring electrode terminal portion 107.

The wiring portion of the wiring electrode 108 extends toward the wiring electrode terminal portion 107 from the electrode portion 108*a*. The electrode portion 108*a* of the wiring electrode 108 is disposed coaxially with the nozzle 101. An inner circumferential portion of the electrode portion 108*a* is slightly separated from the nozzle 101.

The wiring electrodes 108 are formed of, for example, a Pt (platinum) thin film. However, the wiring electrodes 108 may be formed of any of other materials such as Ni (nickel), Cu (copper), Al (aluminum), Ag (silver), Ti (titanium), W (tantalum), Mo (molybdenum), or Au (gold).

The shared electrode 106 is connected to the plurality of piezoelectric films 111. The shared electrode 106 includes the above-mentioned plurality of electrode portions 106*a*, a plurality of wiring portions, and the above-mentioned two shared electrode terminal portions 105.

The wiring portion of the shared electrode 106 extends from the electrode portion 106*a* to the opposite side of the wiring portion of the wiring electrode 108. The wiring portions of the shared electrode 106 join at an end of the nozzle plate 100 in the Y-axis direction, as shown in FIG. 2, and extend to both ends of the nozzle plate 100 in the X-axis direction. The electrode portion 106*a* is provided coaxially around the nozzle 101. An inner circumferential portion of the electrode portion 106*a* is spaced separated from the outer circumference of nozzle 101. The shared electrode terminal portions 105 are respectively disposed at opposed ends of the nozzle plate 100 in the X-axis direction.

The shared electrode 106 may be formed of, for example, a Pt (platinum)/Ti (titanium) thin film. However, the shared electrode 106 may be formed of any of other materials such as Ni, Cu, Al, Ti, W, Mo, or Au.

As shown in FIG. 3, the protective film 113 is provided on the second surface 502 of the vibration plate 109. The protective film 113 covers the second surface 502 of the vibration plate 109, the shared electrode 106, the wiring electrode 108, and the piezoelectric film 111.

The protective film 113 maybe formed of polyimide. The protective film 113 is not limited thereto, and may be formed of any of other materials such as a resin, a ceramic, or a metal (alloy). The resin used is a plastic material such as ABS (acrylonitrile.butadiene.styrene), polyacetal, polyamide, polycarbonate, or polyethersulfone. The ceramic used is a nitride or an oxide such as zirconia, silicon carbide, silicon nitride, or barium titanate. The metal used is, for example, aluminum, SUS, or titanium. Meanwhile, when the protective film 113 is formed of a conductive material, the shared electrode 106, the wiring electrode 108, and the piezoelectric film 111 are insulated from each other, for example, by a resin.

The material of the protective film 113 has a Young's modulus that is significantly different from that of the material of the vibration plate 109. A deformation amount of a plate shape is affected by the Young's modulus and a plate thickness of a material. Even when the same force is applied, the deformation amount increases as the Young's modulus decreases and the plate thickness decreases.

The ink-repellent film 116 covers the surface of the protective film 113. The ink-repellent film 116 maybe formed of a silicone-based water repellent material with a water repellent property. However, the ink-repellent film 116 may be formed of any of other materials such as a fluoride-containing organic material.

The ink-repellent film 116 does not cover the shared electrode terminal portions 105, the wiring electrode terminal portions 107, and the protective film 113 around the shared electrode terminal portions 105 and the wiring electrode terminal portions 107, so as to expose such components.

The nozzles 101 extend through the vibration plate 109, the protective film 113, and the ink-repellent film 116. In other words, the nozzles 101 are provided in the vibration plate 109, the protective film 113, and the ink-repellent film 116.

As shown in FIG. 3, the vibration plate 109 includes a first portion 505 and a second portion 506. The first portion 505 is formed of $SiO_2$. The second portion 506 is formed of SiN (silicon nitride). Meanwhile, the first and second portions 505 and 506 are not limited thereto, and may be formed of any of other materials such as $Al_2O_3$ (aluminum oxide), $HfO_2$ (hafnium oxide), $ZrO_2$ (zirconium oxide), or DLC (diamond like carbon).

The material of the vibration plate 109 is selected in consideration of, for example, a heat resistance property, an insulation property (e.g., when ink with high conductivity is used, the influence of ink alteration due to the driving of the actuator 102 is considered), an expansion coefficient, smoothness, and wettability with respect to ink.

An expansion coefficient of $SiO_2$ for forming the first portion 505 is $5\times10^{-7}[K^{-1}]$. That is, a second expansion coefficient in the first embodiment is $5\times10^{-7}[K^{-1}]$. An expansion coefficient of SiN for forming the second portion 506 is $3\times10^{-6}[K^{-1}]$. That is, a third expansion coefficient in the first embodiment is $3\times10^{-6}[K^{-1}]$.

Further, an expansion coefficient of $Al_2O_3$ is $7\times10^{-6}$ $[K^{-1})$, an expansion coefficient of $HfO_2$ is $4\times10^{-6}[K^{-1}]$, an expansion coefficient of $ZrO_2$is $1\times10^{-5}[K^{-1}]$, and an expansion coefficient of DLC is $2\times10^{-6}[K^{-1}]$.

As described above, a second expansion coefficient of the first portion 505 is smaller than a first expansion coefficient of the pressure chamber structure 200. A third expansion coefficient of the second portion 506 is closer to the first expansion coefficient than the second expansion coefficient, and is larger than the second expansion coefficient.

The first portion 505 forms the first surface 501 of the vibration plate 109. The first portion 505 is firmly fixed to the mounting surface 200*a* of the pressure chamber structure 200. The first portion 505 may be provided across the entirety of the mounting surface 200*a*, and covers the pressure chambers 201. However, the first portion 505 may be provided on only a part of the mounting surface 200*a*.

The second portion 506 forms the second surface 502 of the vibration plate 109. The second portion 506 is superposed on the first portion 505, and is firmly fixed to the first portion 505. In other words, the first portion 505 is sandwiched between the pressure chamber structure 200 and the second portion 506.

The above-described inkjet printer 1 performs printing (i.e., image formation) as follows. Ink is supplied to the ink supply port 401 of the ink feed passage structure 400 from the ink tank 11. The ink is supplied to the plurality of pressure chambers 201 via the plurality of ink apertures 301. The ink supplied to the pressure chamber 201 is then supplied into the corresponding nozzle 101 and forms a meniscus in the nozzle 101. The ink supplied from the ink supply port 401 is held with an appropriate negative pressure, so that the ink within the nozzle 101 is held without leaking from the nozzle 101.

A printing instruction signal is input to the driving circuit, for example, by a user's operation. The driving circuit that received the printing instruction outputs the signal to the actuator 102 through the wiring electrode 108. In other words, the driving circuit applies a voltage to the electrode portion 108*a* of the wiring electrode 108. Thereby, an electric field is applied to the piezoelectric film 111 in the same direction as a polarization direction, and the actuator 102 expands and contracts in a direction perpendicular to the direction of the electric field.

The actuator 102 is sandwiched between the vibration plate 109 and the protective film 113. Thus, when the actuator 102 extends in the direction perpendicular to the direction of the electric field, a force for deforming in a concave shape with respect to the pressure chamber 201 side is applied to the vibration plate 109. Furthermore, a force for deforming in a convex shape with respect to the pressure chamber 201 side is applied to the protective film 113. When the actuator 102 contracts in the direction perpendicular to the direction of the electric field, a force for deforming in a convex shape with respect to the pressure chamber 201 side is applied to the vibration plate 109. In addition, a force for deforming in a concave shape with respect to the pressure chamber 201 side is applied to the protective film 113.

The polyimide film of the protective film 113 has a Young's modulus smaller than that of the vibration plate 109. For this reason, the protective film 113 has a larger deformation amount with respect to the same force. When the actuator 102 extends in the direction perpendicular to the direction of the electric field, the nozzle plate 100 is deformed in a convex shape with respect to the pressure chamber 201 side. Thereby, the capacity of the pressure chamber 201 is reduced because the protective film 113 has a larger deformation amount in a convex shape with respect to the pressure chamber 201 side. Conversely, when the actuator 102 contracts in the direction perpendicular to the direction of the electric field, the nozzle plate 100 is deformed in a concave shape with respect to the pressure chamber 201 side. Thereby, the capacity of the pressure chamber 201 is increased because the protective film 113 has a larger deformation amount in a concave shape with respect to the pressure chamber 201 side.

When the volume of the pressure chamber 201 is increased or reduced by the deformation of the vibration plate 109, a pressure change occurs in the ink of the pressure chamber 201. The ink supplied to the nozzles 101 is discharged by the pressure change.

As a difference in the Young's modulus between the vibration plate 109 and the protective film 113 increases, a difference in deformation amount of the vibration plate 109 when the same voltage is applied to the actuator 102 increases.

For this reason, as the difference in the Young's modulus between the vibration plate 109 and the protective film 113 increases, ink can be discharged at a lower voltage.

When a voltage is applied to the actuator 102 in a case where the vibration plate 109 and the protective film 113 have the same film thickness and Young's modulus, forces that cause the deformation by the same amount in the directly opposite directions are applied to the vibration plate 109 and the protective film 113, and thus the vibration plate 109 is not deformed.

Meanwhile, as described above, a deformation amount of a plate is affected by not only the Young's modulus of a material but also a plate thickness. For this reason, when a difference occurs in the deformation amount between the vibration plate 109 and the protective film 113, both the Young's modulus of each material and the film thicknesses of each material are considered. Even when the materials of the vibration plate 109 and the protective film 113 have the same Young's modulus, if there is a difference between the film thicknesses, ink can be discharged.

Next, an example of a method of manufacturing the ink jet head 10 will be described. First, the first portion 505 of the vibration plate 109 is formed on the pressure chamber structure 200 (which is formed from a silicon wafer) before the pressure chamber 201 is formed. The $SiO_2$ film for forming the first portion 505 is formed on the entirety of the mounting surface 200*a* of the pressure chamber structure 200 by using, for example, a CVD method. Next, the SiN film for forming the second portion 506 is formed on the first portion 505 by using, for example, a CVD method. Alternatively, the $SiO_2$ film may be formed by thermal oxidation. Also, the SiN film may be formed using a sputtering method.

Figure 4:
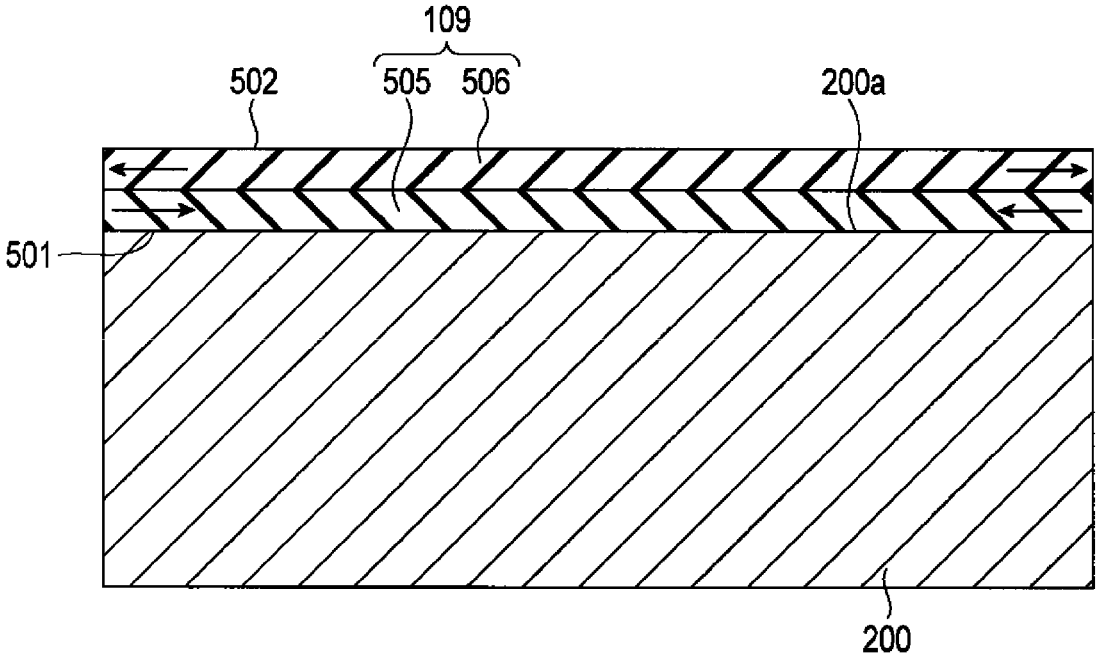
FIG. 4 is a cross-sectional view showing a pressure chamber structure in which a vibration plate is formed, according to the first embodiment.

FIG. 4 is a cross-sectional view showing the pressure chamber structure 200 in which the vibration plate 109 is formed. When forming the vibration plate 109, the pressure chamber structure 200 is heated to several hundred degrees. After the vibration plate 109 is formed, the pressure chamber structure 200 is returned to equal to or lower than room temperature, and thus the pressure chamber structure 200 and the vibration plate 109 contract.

The second expansion coefficient of the first portion 505 of the vibration plate 109 is smaller than the first expansion coefficient of the pressure chamber structure 200. Accordingly, the pressure chamber structure 200 tends to contract further than the first portion 505. For this reason, as shown by arrows in FIG. 4, compressive stress occurs in the first portion 505.

The third expansion coefficient of the second portion 506 is closer to the first expansion coefficient than the second expansion coefficient of the first portion 505, and is larger than the second expansion coefficient. Accordingly, the second portion 506 tends to contract further than the first portion 505. For this reason, as shown by arrows in FIG. 4, tensile stress occurs in the second portion 506.

As described above, stresses occur in opposite directions in the first portion 505 and the second portion 506. Because the stresses occur in opposite directions, the compressive stress occurring in the first portion 505 and the tensile stress occurring in the second portion 506 tend to cancel each other out.

Next, the vibration plate 109 is patterned to form the nozzles 101. The patterning is performed by forming an etching mask on a portion of the vibration plate 109 and removing the unmasked portions of the vibration plate 109 through etching.

Next, the shared electrode 106 is formed on the second surface 502 of the vibration plate 109. For example, Ti and Pt are sequentially deposited using a sputtering method. However, the shared electrode 106 maybe formed by any of other manufacturing methods such as deposition or plating.

After the shared electrode 106 is formed, the plurality of electrode portions 106*a*, the wiring portion, and the two shared electrode terminal portions 105 are formed through patterning. The patterning is performed by forming an etching mask on an electrode film and removing the unmasked portions of electrode material through etching.

Since the nozzle 101 is formed at the center of the electrode portion 106*a* of the shared electrode 106, a portion of the electrode portion 106*a* having no electrode film, concentric with the center of the electrode portion 106*a*, is formed. The shared electrode 106 is patterned, and thus the vibration plate 109 is exposed at positions other than the electrode portion 106*a* of the shared electrode 106, the wiring portion, and the shared electrode terminal portion 105.

Next, the piezoelectric film 111 is formed on the shared electrode 106. The piezoelectric film 111 is formed using, for example, an RF magnetron sputtering method. After the formation of the piezoelectric film, the piezoelectric film 111 is heated at a temperature of 500° C. for three hours in order to impart piezoelectricity to the piezoelectric film 111. Thereby, the piezoelectric film 111 obtains a good piezoelectric performance. The piezoelectric film 111 may be formed using any of various manufacturing methods such as a CVD (chemical vapor deposition) method, a sol-gel method, an AD (aerosol deposition) method, or a hydrothermal synthesis method. The piezoelectric film 111 is patterned by etching.

Since the nozzle 101 is formed at the center of the piezoelectric film 111, a portion having no piezoelectric film is formed which is concentric with the nozzle 101. The vibration plate 109 is exposed in the portion not including the piezoelectric film 111. The piezoelectric film 111 covers the electrode portion 106*a* of the shared electrode 106.

Next, the insulating film 112 is formed on a part of the piezoelectric film 111 and a part of the shared electrode 106. The insulating film 112 is formed using a CVD method capable of realizing a good insulation property through low-temperature film formation. The insulating film 112 is patterned after the film formation. In order to prevent defects from occurring due to patterning process variations, the insulating film 112 covers a part of the piezoelectric film 111. The insulating film 112 covers the piezoelectric film 111 to the extent that a deformation amount of the piezoelectric film 111 is not obstructed.

Next, the wiring electrode 108 is formed on the vibration plate 109, the piezoelectric film 111, and the insulating film 112. The wiring electrode 108 maybe formed using a sputtering method. The wiring electrode 108 also may be formed using any of various manufacturing methods such as vacuum deposition or plating.

The electrode portion 108*a*, the wiring portion, and the wiring electrode terminal portion 107 are formed by patterning the formed wiring electrode 108. The patterning is performed by forming an etching mask on an electrode film and removing unmasked portions of electrode material through etching.

Since the nozzle 101 is formed at the center of the electrode portion 108*a* of the wiring electrode 108, a portion of the wiring electrode 108 having no electrode film is formed concentric with the electrode portion 108*a*. The electrode portion 108*a* of the wiring electrode 108 covers the piezoelectric film 111.

Next, the protective film 113 is formed on the vibration plate 109, the wiring electrode 108, the shared electrode 106, and the insulating film 112. The protective film 113 is formed by depositing a solution containing a polyimide precursor through spin coating, and performing thermal polymerization and removal of the solution through baking. The protective film may be formed through spin coating, and thus a film having a smooth surface is formed. The protective film 113 may also be formed using any of various manufacturing methods such as CVD, vacuum deposition, plating, or spin on methods.

Next, patterning is performed to expose the shared electrode terminal portion 105 and the wiring electrode terminal portion 107 and to open the nozzles 101. When non-photosensitive polyimide is used for the protective film 113, patterning is performed by forming an etching mask on the non-photosensitive polyimide film and removing unmasked portions of the polyimide film through etching.

Next, a protective film cover tape is adhered onto the protective film 113. The pressure chamber structure 200 to which the protective film cover tape is adhered is inverted vertically, and the plurality of pressure chambers 201 are formed in the pressure chamber structure 200.

In detail, first, the protective film cover tape is attached onto the protective film 113. For example, the protective film cover tape is a rear surface protection tape for chemical mechanical polishing (CMP) of a silicon wafer.

An etching mask is formed on the pressure chamber structure 200 which is a silicon wafer, and the unmasked portions of the silicon wafer are removed using a so-called vertical deep dry etching method exclusively for a silicon substrate, and thus the pressure chambers 201 are formed.

SF6 gas used for the above-mentioned etching does not have an etching effect on the $SiO_2$ film and the SiN film of the vibration plate 109 and the polyimide film of the protective film 113. For this reason, the progression of the dry etching of the silicon wafer for forming the pressure chambers 201 is stopped at the vibration plate 109.

Meanwhile, the above-described etching may use any of various methods such as a wet etching method using a chemical solution or a dry etching method using plasma. The etching method and the etching conditions may be changed using a material such as an insulating film, an electrode film, or a piezoelectric film. After an etching process using a photosensitive resist film is finished, the remaining photosensitive resist film is removed using a solution.

Next, the separate plate 300 and the ink feed passage structure 400 are attached to the pressure chamber structure 200. That is, the separate plate 300, which is adhered to the ink feed passage structure 400, is adhered to the pressure chamber structure by using an epoxy resin agent.

Next, a cover tape is attached to the protective film 113 so as to cover the shared electrode terminal portions 105 and the wiring electrode terminal portions 107. The cover tape is formed of a resin, and can be easily desorbed from the protective film 113. The cover tape prevents dust and the ink-repellent film 116 to be described below from adhering to the shared electrode terminal portion 105 and the wiring electrode terminal portion 107.

Next, the ink-repellent film 116 is formed on the protective film 113. The ink-repellent film 116 is formed on the protective film 113 by spin coating a liquid ink-repellent film material. During the spin coating process, positive pressure air is injected from the ink supply port 401 so that the positive pressure air is discharged from the nozzles 101 connected to the ink supply passage 402. In this state, when the liquid ink-repellent film material is applied, the ink-repellent film material is prevented from adhering to inner walls of the nozzles 101.

After the ink-repellent film 116 is formed, the cover tape is peeled off from the protective film 113. Thereby, the ink jet head 10 shown in FIG. 3 is formed. The ink jet head 10 is mounted inside the ink jet printer 1. The driving circuit is then connected to the shared electrode terminal portions 105 and the wiring electrode terminal portions 107.

According to the ink jet printer 1 of the first embodiment, the vibration plate 109 includes the first portion 505 having the second expansion coefficient, and the second portion 506 having the third expansion coefficient. The second expansion coefficient is smaller than the first expansion coefficient of the pressure chamber structure 200, but the third expansion coefficient is closer to the first expansion coefficient than the second expansion coefficient.

Compressive stress or tensile stress occurs in the first portion 505 due to a difference between the first expansion coefficient and the second expansion coefficient. However, since the third expansion coefficient is closer to the first expansion coefficient than the second expansion coefficient, stress smaller than that occurring in the first portion 505 or stress in a direction opposite to the first portion 505 occurs in the second portion 506. Thereby, the stress occurring in the second portion 506 reduces or cancels out the stress occurring in the first portion 505. Therefore, the stress occurring in the entirety of the vibration plate 109 is reduced, and bending occurring in the pressure chamber structure 200 and the vibration plate 109 is reduced.

The first portion 505 having the second expansion coefficient is fixed to the mounting surface 200*a* of the pressure chamber structure 200. The second portion 506 having the third expansion coefficient is superposed on the first portion 505. For this reason, the tensile stress occurring in the second portion 506 cancels out the compressive stress occurring in the first portion 505. Therefore, bending occurring in the pressure chamber structure 200 and the vibration plate 109 is reduced.

Meanwhile, the second portion 506 may be fixed to the mounting surface 200*a* of the pressure chamber structure 200, and the first portion 505 may be superposed on the second portion 506. In this case, the second portion 506 formed of SiN has a contraction amount smaller than that of the pressure chamber structure 200. For this reason, compressive stress occurs in the second portion 506.

The first portion 505 formed of $SiO_2$ has a contraction amount smaller than that of the second portion 506. For this reason, compressive stress occurs in the first portion 505. The compressive stress occurring in the first portion 505 is smaller than the compressive stress occurring in the second portion 506.

The compressive stress occurring in the entire vibration plate 109 is smaller than compressive stress occurring when the vibration plate 109 is formed of only $SiO_2$. That is, the vibration plate 109 includes the first and second portions 505 and 506, and stress occurring in the vibration plate 109 is reduced. Bending occurring in the vibration plate 109 and the pressure chamber structure 200 is reduced.

In addition, in the first embodiment, the second expansion coefficient of the first portion 505 is smaller than the first expansion coefficient of the pressure chamber structure 200, but the second expansion coefficient is not limited to the above description. That is, the second expansion coefficient may be larger than the first expansion coefficient. The first portion 505 may be formed of, for example, $ZrO_2$.

When the second expansion coefficient is larger than the first expansion coefficient, the first portion 505 of the vibration plate 109 tends to contract further than the pressure chamber structure 200. For this reason, tensile stress occurs in the first portion 505.

For the second portion 506, a material having an expansion coefficient that is closer to the first expansion coefficient than the second expansion coefficient is used. For example, the second portion 506 is formed of SiN. That is, the third expansion coefficient of the second portion 506 is closer to the first expansion coefficient than the second expansion coefficient, and is smaller than the second expansion coefficient.

Since the third expansion coefficient is smaller than the first expansion coefficient, the second portion 506 of the vibration plate 109 has a contraction amount smaller than that of the first portion 505. For this reason, compressive stress occurs in the second portion 506.

As described above, stresses in opposite directions occur in the first portion 505 and the second portion 506. Thereby, the stress occurring in the second portion 506 reduces or cancels out the stress occurring in the first portion 505. Therefore, stress occurring in the entirety of the vibration plate 109 is reduced. Thus it is possible to reduce bending occurring in the pressure chamber structure 200 and the vibration plate 109.

Next, a second embodiment will be described with reference to FIG. 5. Components in the second embodiment having the same function as the ink tank 11 of the first embodiment are denoted by the same reference numerals. Further, the description of the component may be partially or totally omitted.

Figure 5:
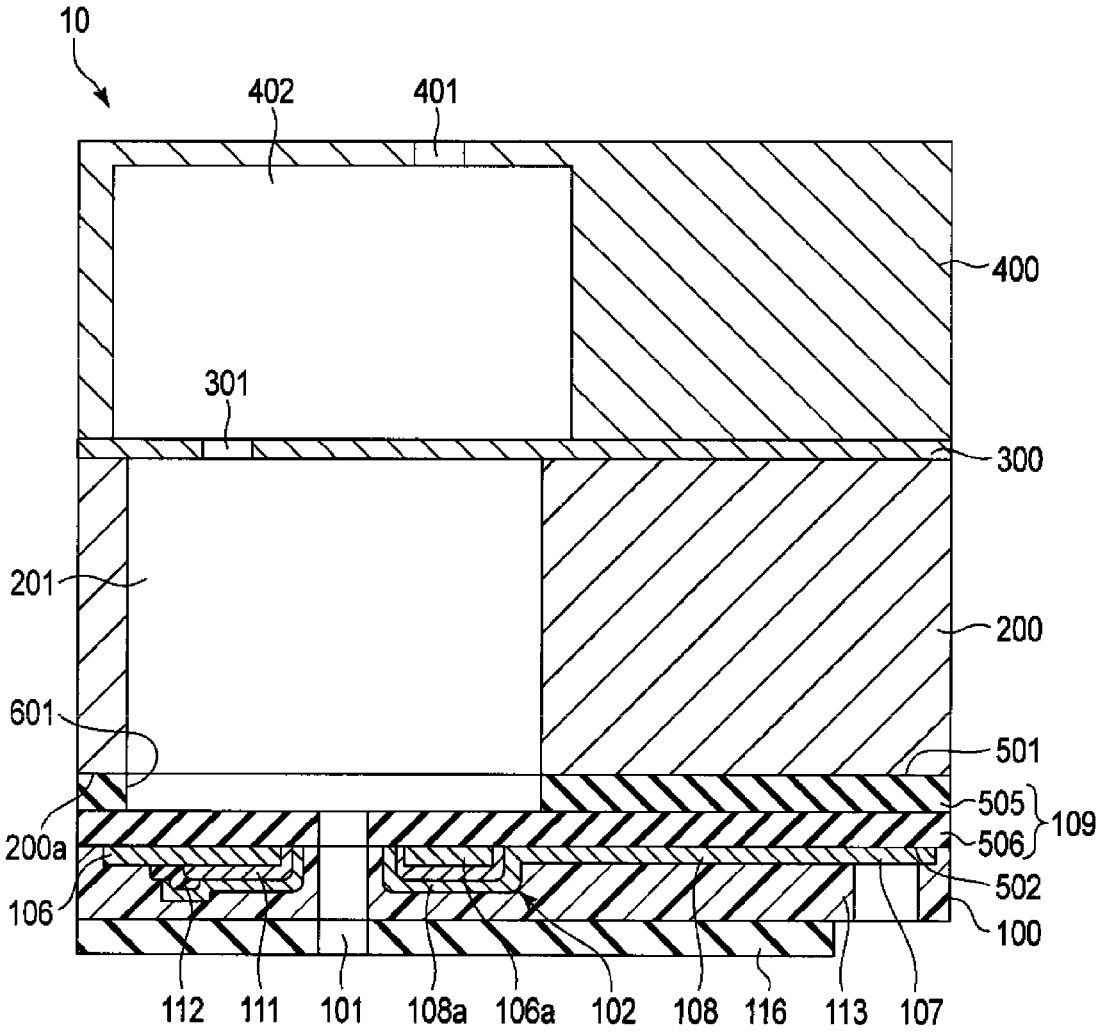
FIG. 5 is a cross-sectional view showing an inkjet head according to a second embodiment.

FIG. 5 is a cross-sectional view showing the ink jet head according to the second embodiment. In the second embodiment, a plurality of connection portions 601 is provided in the first portion 505 of the vibration plate 109.

The connection portion 601 is a circular hole that is provided in the first portion 505. The connection portions 601 are disposed so as to correspond to the pressure chambers 201, and are located coaxially with the nozzles 101 and the pressure chambers 201. As shown in FIG. 5, an external diameter of the connection portion 601 is the same as an external diameter of the pressure chamber 201. However, the external diameter of the connection portion 601 may be different from the external diameter of the pressure chamber 201. The connection portions 601 are provided, and thus the second portion 506 of the vibration plate 109 blocks the pressure chambers 201.

The connection portions 601 are formed, for example, by etching. After the pressure chambers 201 are formed, the $SiO_2$ film for forming the first portion 505 of the vibration plate 109 is removed by etching. In the etching process, the SiN film for forming the second portion 506 is not affected by the etching effect. The progression of the etching of the first portion 505 is stopped at the second portion 506.

According to the ink jet printer 1 of the second embodiment, the plurality of connection portions 601 are provided in the first portion 505. In other words, a part of the first portion 505 is removed. Thereby, stress occurring in the entirety of the first portion 505 is reduced, and bending occurring in the pressure chamber structure 200 and the vibration plate 109 is reduced.

Figure 6:
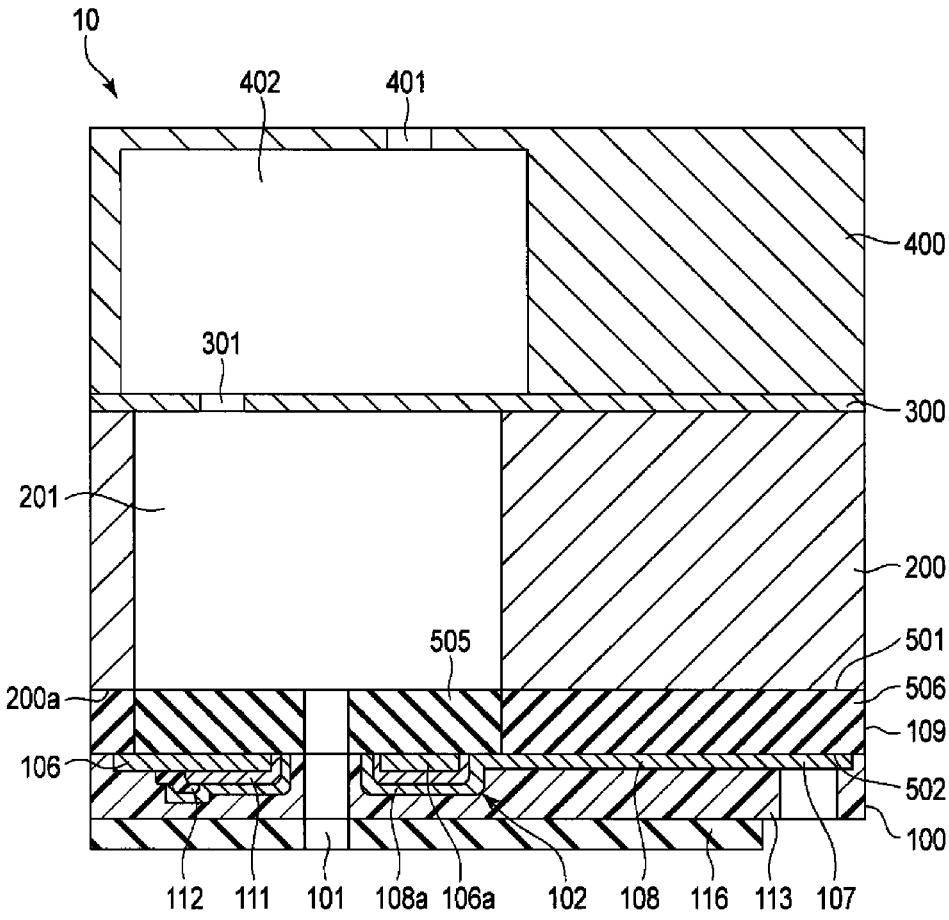
FIG. 6 is a cross-sectional view showing an inkjet head according to a third embodiment.

Next, a third embodiment will be described with reference to FIG. 6 and FIG. 7. FIG. 6 is a cross-sectional view showing the ink jet head 10 according to the third embodiment . As shown in FIG. 6, the vibration plate 109 of the third embodiment includes a plurality of the first portions 505 and the second portion 506.

According to the third embodiment, the first portion 505 is formed in a circular plate shape. The plurality of first portions 505 are disposed so as to correspond to the plurality of pressure chambers 201, and are located coaxially with the nozzles 101 and the pressure chambers 201. In FIG. 6, an external diameter of the first portion 505 is substantially the same as an external diameter of the pressure chamber 201. However, the external diameter of the first portion 505 may be different from the external diameter of the pressure chamber 201. The first portion 505 covers the pressure chambers 201.

The second portion 506 is provided across the remainder of the mounting surface 200*a* of the pressure chamber structure 200. The second portion 506 is provided around the plurality of first portions 505. In other words, the plurality of first portions 505 are arranged in a plurality of holes provided in the second portion 506. An outer circumference of the first portion 505 and an inner circumference of the hole provided in the second portion 506 may be separated from each other, or a part of the pressure chamber structure 200 may be interposed therebetween.

The first portion 505 and the second portion 506 together form the first surface 501 and the second surface 502. In other words, a surface of the second portion 506 which faces the pressure chamber structure 200 is formed on the same plane as a surface of the first portion 505 which faces the pressure chamber structure 200. A surface of the second portion 506 which is on the opposite side of the pressure chamber structure 200 is formed on the same plane with a surface of the first portion 505 which is on the opposite side of the pressure chamber structure 200.

In the third embodiment, the plurality of first portions 505 of the vibration plate 109 are formed by etching the $SiO_2$ film formed on the mounting surface 200*a* of the pressure chamber structure 200 by using, for example, a CVD method. For example, a plurality of etching masks are formed on the formed $SiO_2$ film, and the unmasked portions of the $SiO_2$ film are removed by etching.

The second portion 506 is also formed by etching the SiN film formed on the mounting surface 200*a* of the pressure chamber structure 200 by using, for example, a CVD method. For example, a plurality of etching masks are formed in places other than the places where the first portions 505 are formed, and the unmasked portions of the SiN film are removed by etching. Thereby, the first and second portions 505 and 506 of the vibration plate 109 are formed.

Figure 7:
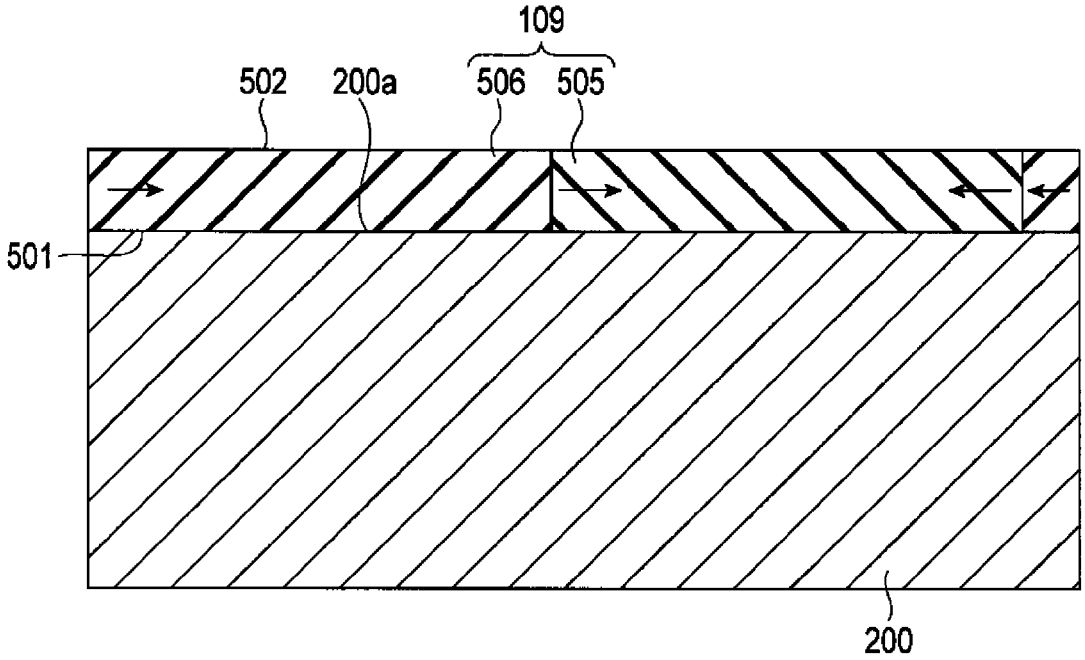
FIG. 7 is a cross-sectional view showing a pressure chamber structure in which a vibration plate is formed.

FIG. 7 is a cross-sectional view showing the pressure chamber structure 200 in which the vibration plate 109 according to the third embodiment is formed. The second expansion coefficient of the first portion 505 of the vibration plate 109 is smaller than the first expansion coefficient of the pressure chamber structure 200. In other words, the pressure chamber structure 200 tends to contract further than the first portion 505. For this reason, as shown by arrows in FIG. 7, compressive stress occurs in the first portion 505.

The third expansion coefficient of the second portion 506 is smaller than the first expansion coefficient, is closer to the first expansion coefficient than the second expansion coefficient of the first portion 505, and is larger than the second expansion coefficient. In other words, the second portion 506 has a contraction amount that is smaller than that of the pressure chamber structure 200 but is larger than that of the first portion 505. For this reason, as shown by arrows in FIG. 7, compressive stress smaller than that occurring in the first portion 505 occurs in the second portion 506.

As described above, a large compressive stress occurs in the plurality of first portions 505, while a small compressive stress occurs in the second portion 506. Thereby, the compressive stress occurring in the entirety of the vibration plate 109 becomes smaller than the compressive stress occurring in the first portion 505.

As described above, stresses having different strengths occur in the first portions 505 and the second portion 506. Thereby, the large compressive stress occurring in the first portions 505 is reduced by the small compressive stress occurring in the second portion 506.

According to the ink jet printer 1 of the third embodiment, since a structure is used in which the second portion 506 having an expansion coefficient close to that of the pressure chamber structure 200 surrounds the first portions 505, stress acting on the entireties of the vibration plate 109 and the pressure chamber structure 200 can be reduced. In addition, the first portion 505 having an expansion coefficient that is significantly different from that of the pressure chamber structure 200 is provided in only a region covering the pressure chamber 201. For this reason, stress acting on the vibration plate 109 and the pressure chamber structure 200 can be reduced. Thereby, it is possible to prevent bending from occurring in the vibration plate 109 and the pressure chamber structure 200.

Meanwhile, the third expansion coefficient of the second portion 506 may be larger than the first expansion coefficient of the pressure chamber structure 200. In this case, tensile stress occurs in the second portion 506, and thus cancels out the compressive stress occurring in the first portion 505. Thereby, it is possible to reduce bending of the vibration plate 109 and the pressure chamber structure 200.

In addition, a plurality of the second portions 506 may cover the pressure chambers 201, and the first portions 505 may be provided around the second portions 506. That is, the plurality of second portions 506 are fitted into a plurality of holes provided in the first portions 505. Since the vibration plate 109 includes the first and second portions 505 and 506, stress occurring in the entire vibration plate 109 is reduced, and thus it is possible to reduce bending occurring in the vibration plate 109 and the pressure chamber structure 200.

Figure 8:
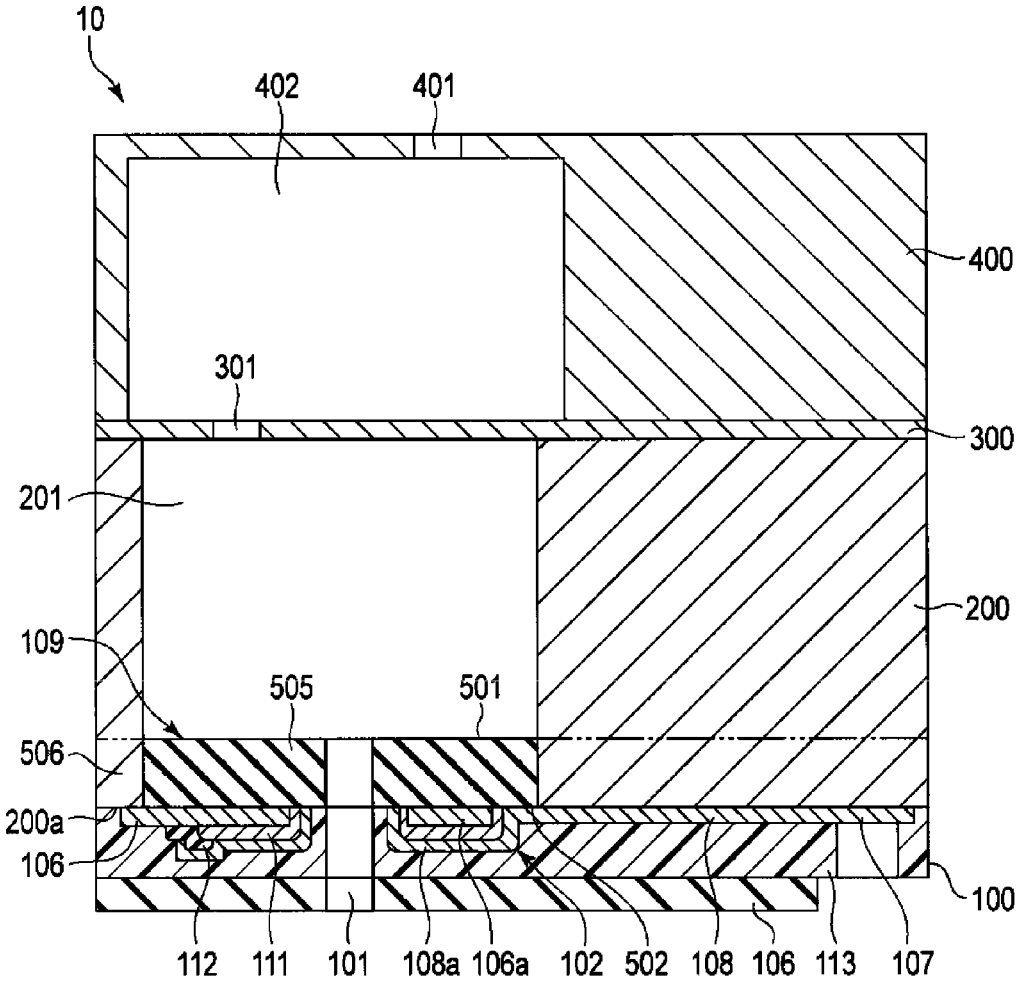
FIG. 8 is a cross-sectional view showing an inkjet head according to a fourth embodiment.

Next, a fourth embodiment will be described with reference to FIG. 8. FIG. 8 is a cross-sectional view showing the ink jet head 10 according to the fourth embodiment. As shown in FIG. 8, the second portion 506 of the fourth embodiment is integrally formed with the pressure chamber structure 200. In other words, the second portion 506 is formed of a portion of the pressure chamber structure 200. That is, the second portion 506 is formed of a silicon wafer, and the third expansion coefficient is $4\times10^{-6}[K^{-1}]$, which that is the same as the first expansion coefficient of the pressure chamber structure 200.

Similar to the third embodiment, the second portion 506 is provided around the plurality of first portions 505. In FIG. 8, the second portion 506 is distinguished from the pressure chamber structure 200 by using a dashed-two dotted line.

In the fourth embodiment, the vibration plate 109 is formed in the following manner. First, a plurality of concavities are formed by etching in a plurality of portions of the silicon wafer, for forming the pressure chamber structure 200. The plurality of portions are portions where the first portions 505 are provided. The concavities are formed in the silicon wafer, and thus the second portion 506 is formed.

Next, an $SiO_2$ film is formed in each of the plurality of concavities by using a CVD method. The plurality of first portions 505 are formed by etching the $SiO_2$ films. For example, a plurality of etching masks are formed on the $SiO_2$ films formed in the plurality of concavities, and the $SiO_2$ films other than the etching masks are removed by etching. Thereby, the first and second portions 505 and 506 of the vibration plate 109 are formed.

The second expansion coefficient of the first portion 505 of the vibration plate 109 is smaller than the first expansion coefficient of the pressure chamber structure 200. In other words, the pressure chamber structure 200 tends to contract further than the first portion 505. For this reason, compressive stress occurs in the first portions 505.

The third expansion coefficient of the second portion 506 is equal to the first expansion coefficient. In other words, the second portion 506 contracts in the same manner as the pressure chamber structure 200. For this reason, the second portion 506 does not generate stress relative to the pressure chamber structure 200.

As described above, a large compressive stress occurs in the plurality of first portions 505, while stress does not occur in the second portion 506. Thereby, the compressive stress occurring in the entire vibration plate 109 becomes smaller than the compressive stress occurring in the first portion 505.

As described above, stress occurs in the first portion 505, while stress does not occur in the second portion 506. Thereby, the large compressive stress occurring in the first portion 505 is reduced.

According to the ink jet printer 1 of the fourth embodiment, the second portion 506 is formed integrally with the pressure chamber structure 200. That is, the second portion 506 is formed without using a process such as a film-formation process. Thereby, it is possible to reduce a number of processes and materials. A manufacturing cost of the ink jet printer 1 can be reduced.

According to at least one ink jet head and the image forming apparatus that are described above, a vibration plate includes a first portion having a second expansion coefficient different from a first expansion coefficient of a substrate, and a second portion having a third expansion coefficient closer to the first expansion coefficient than the second expansion coefficient. Thereby, it is possible to reduce stress acting on the substrate. Thus bending of the substrate can be reduced.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, the nozzle 101 is an example of an opening portion, but the opening portion is not limited thereto. For example, an opening portion larger than the nozzle 101 may be provided in the vibration plate 109, and the nozzle 101 may be formed on the inner side of the opening portion by the protective film 113.

What is claimed is:

1. An ink jet head comprising: a substrate including a mounting surface and a pressure chamber formed therein and open to the mounting surface, the substrate having a first expansion coefficient; a vibration plate including a first surface fixed to the mounting surface of the substrate, a second surface located on the opposite side of the first surface, an opening portion open to the pressure chamber, a first portion including the first surface and having a second expansion coefficient different from the first expansion coefficient, and a second portion including the second surface and having a third expansion coefficient different from the second expansion coefficient; and a piezoelectric element provided on the second surface of the vibration plate and configured to deform the vibration plate to thereby change a volume of the pressure chamber, wherein the second expansion coefficient is smaller than the first expansion coefficient and smaller than the third expansion coefficient, and wherein the third expansion coefficient is closer to the first expansion coefficient than the second expansion coefficient is to the first expansion coefficient.

2. The ink jet head according to claim 1, wherein:

the first portion of the vibration plate covers the pressure chamber, the second portion of the vibration plate is provided around the first portion or the second portion that blocks the pressure chamber, and the first and second portions together form the first surface and the second surface of the vibration plate.

3. The ink jet head according to claim 1, wherein:

the first portion of the vibration plate blocks the pressure chamber, and the second portion of the vibration plate is formed integrally with the substrate, is provided around the first portion, and forms the first surface and the second surface of the vibration plate in conjunction with the first portion.

4. The ink jet head according to claim 1, wherein:

the second portion is integrally formed from the substrate.

5. An ink jet head comprising: a pressure chamber formed in a substrate having a mounting surface, the pressure chamber formed therein and being open to the mounting surface, and the substrate having a first expansion coefficient; a vibration plate including a first surface fixed to the mounting surface of the substrate, a second surface located on the opposite side of the first surface, an opening portion open to the pressure chamber, a first portion including the first surface and having a second expansion coefficient different from the first expansion coefficient, and a second portion including the second surface and having a third expansion coefficient different from the second expansion coefficient; a piezoelectric element provided on the second surface of the vibration plate and configured to deform the vibration plate to thereby change a volume of the pressure chamber; and a wiring electrode configured to supply a driving voltage to the piezoelectric element to thereby cause the piezoelectric element to deform the vibration plate, wherein the second expansion coefficient is smaller than the first expansion coefficient and smaller than the third expansion coefficient, and wherein the third expansion coefficient is closer to the first expansion coefficient than the second expansion coefficient is to the first expansion coefficient.

6. The ink jet head according to claim 5, wherein:

the first portion of the vibration plate includes the first surface fixed to the mounting surface of the substrate, and the second portion of the vibration plate includes the second surface.

7. The ink jet head according to claim 5, wherein:

the second expansion coefficient is smaller than the first expansion coefficient and smaller than the third expansion coefficient.

8. The ink jet head according to claim 7, wherein:

the first and third expansion coefficients are substantially similar.

9. The ink jet head according to claim 5 wherein:

the first portion of the vibration plate covers the pressure chamber, the second portion of the vibration plate is provided around the first portion or the second portion that blocks the pressure chamber, and the first and second portions together form the first surface and the second surface of the vibration plate.

10. The ink jet head according to claim 5, wherein:

the first portion of the vibration plate covers the pressure chamber, and the second portion of the vibration plate is disposed around the first portion, and forms the first surface and the second surface of the vibration plate in conjunction with the first portion.

11. The ink jet head according to claim 5, wherein:

the second portion is integrally formed from the substrate.

* * * * *